US007647748B2

(12) United States Patent
Griggs et al.

(10) Patent No.: US 7,647,748 B2
(45) Date of Patent: Jan. 19, 2010

(54) METHOD OF PACKAGING USING AN EMBOSSED NETTING CHUTE

(75) Inventors: Samuel D. Griggs, Raleigh, NC (US); Dennis J. May, Pittsboro, NC (US)

(73) Assignee: Tipper Tie, Inc., Apex, NC (US)

( * ) Notice: Subject to any disclaimer, the term of this patent is extended or adjusted under 35 U.S.C. 154(b) by 0 days.

(21) Appl. No.: 12/201,244

(22) Filed: Aug. 29, 2008

(65) Prior Publication Data

US 2008/0313999 A1 Dec. 25, 2008

Related U.S. Application Data

(62) Division of application No. 11/234,494, filed on Sep. 23, 2005, now Pat. No. 7,430,839.

(60) Provisional application No. 60/615,753, filed on Oct. 4, 2004.

(51) Int. Cl.
*B65B 51/04* (2006.01)
*B65B 39/00* (2006.01)
*B65B 9/15* (2006.01)

(52) U.S. Cl. ..... 53/417; 53/459; 53/469; 53/138.4; 53/567; 53/576

(58) Field of Classification Search ..... 53/417, 53/459, 469, 138.1–138.4, 567, 576; 141/114, 141/391; 193/2 R, 25 A, 25 R; D7/700
See application file for complete search history.

(56) References Cited

U.S. PATENT DOCUMENTS 2,124,021 A 7/1938 James
2,284,488 A 5/1942 Johnson
2,720,055 A 10/1955 Morris
2,812,784 A 11/1957 Palmer
3,054,236 A 9/1962 Stroop
3,337,089 A 8/1967 Bronfman
3,342,017 A 9/1967 Yerkey
3,358,418 A 12/1967 Manetta
3,389,533 A 6/1968 Tipper et al.
3,499,259 A 3/1970 Tipper et al.
3,587,204 A 6/1971 George
3,662,514 A 5/1972 Goss
3,719,022 A 3/1973 Cherio et al.
3,732,662 A 5/1973 Paxton (Continued)

FOREIGN PATENT DOCUMENTS

JP 60184419 A 9/1985

(Continued)

OTHER PUBLICATIONS

Product Brochure, 1 sheet, "Tipper Clipper -Signature Series SZ3214 Double Clipper for Netting" (2002).

(Continued)

*Primary Examiner*—Stephen F Gerrity
(74) *Attorney, Agent, or Firm*—Meyers Bigel Sibley & Sajovec, P.A.

(57) ABSTRACT

Netting chutes suitable for use with manual, automatic and semi-automatic packaging operations to enclose product in netting packaging include chutes with embossed floors.

21 Claims, 8 Drawing Sheets

U.S. PATENT DOCUMENTS

| | | | |
|---|---|---|---|
| 3,797,199 | A | 3/1974 | Seifert |
| 3,815,323 | A | 6/1974 | Longo |
| 3,902,552 | A | 9/1975 | McLain |
| 3,945,171 | A | 3/1976 | Marietta et al. |
| D243,158 | S | 1/1977 | Bolwell |
| 4,091,595 | A | 5/1978 | Pelster et al. |
| 4,149,560 | A | 4/1979 | Berg |
| 4,247,005 | A | 1/1981 | Buxton |
| 4,430,772 | A | 2/1984 | Michel et al. |
| 4,478,300 | A | 10/1984 | Mikami |
| 4,505,003 | A | 3/1985 | Becker et al. |
| 4,537,006 | A | 8/1985 | Pieri |
| 4,590,748 | A | 5/1986 | Harrison et al. |
| 4,651,498 | A | 3/1987 | Piereder |
| 4,683,700 | A | 8/1987 | Evans et al. |
| 4,766,713 | A | 8/1988 | Evans |
| 4,792,031 | A | 12/1988 | Warner et al. |
| 5,016,424 | A | 5/1991 | Stirling |
| 5,042,234 | A | 8/1991 | Evans et al. |
| 5,044,144 | A | 9/1991 | Foote et al. |
| 5,107,666 | A | 4/1992 | Rahtican |
| 5,161,347 | A | 11/1992 | May et al. |
| D340,467 | S | 10/1993 | Pollak et al. |
| 5,402,625 | A | 4/1995 | Halstead |
| 5,421,142 | A | 6/1995 | Cullen |
| 5,426,910 | A | 6/1995 | Cullen |
| 5,461,975 | A | 10/1995 | Driggs |
| 5,495,701 | A | 3/1996 | Poteat et al. |
| 5,570,561 | A | 11/1996 | May et al. |
| 5,586,424 | A | 12/1996 | Chen et al. |
| 5,715,656 | A | 2/1998 | Pearce |
| 5,884,346 | A | 3/1999 | Hengl |
| 5,988,348 | A | 11/1999 | Martin et al. |
| 6,052,972 | A | 4/2000 | Rea et al. |
| 6,131,367 | A | 10/2000 | Fukuda et al. |
| 6,216,842 | B1 | 4/2001 | Beale et al. |
| 6,250,450 | B1 | 6/2001 | Howard |
| 6,684,999 | B1 | 2/2004 | Howard |
| 6,694,711 | B1 | 2/2004 | Cullen |
| 6,708,742 | B2 | 3/2004 | Weathers et al. |
| 6,719,194 | B2 | 4/2004 | Richards |
| 6,729,102 | B2 | 5/2004 | Ailey et al. |
| 6,745,547 | B2 | 6/2004 | Bussey et al. |
| 6,945,171 | B1 | 9/2005 | Coull |
| 7,021,026 | B2 | 4/2006 | Griggs et al. |
| 2003/0013564 | A1 | 1/2003 | McDaniel |
| 2003/0131564 | A1 * | 7/2003 | Ailey et al. ..... 53/413 |
| 2004/0068964 | A1 * | 4/2004 | Kirk et al. ..... 53/417 |
| 2005/0034426 | A1 | 2/2005 | Griggs et al. |
| 2005/0039419 | A1 | 2/2005 | Griggs et al. |
| 2005/0072119 | A1 * | 4/2005 | Griggs et al. ..... 53/417 |
| 2009/0188215 | A1 * | 7/2009 | Laplace ..... 53/551 |

FOREIGN PATENT DOCUMENTS

| | | | |
|---|---|---|---|
| JP | 62204832 | A | 9/1987 |

OTHER PUBLICATIONS

Product Brochure, 1 sheet, "Tipper Netter TN-3000 Automatic Netting-Packaging Machine" (2002).

Product Brochure, 1 sheet, "Tipper Tie-Net, Safely and Quickly Package Plugs Before Shipping" (1999).

Product Brochure, 2 sheets, "Net-All Sleeved Plastic Netting System" (2000).

Product Brochure, 2 sheets, "Tipper Net Z3200 Double Clipper and Plant Netting System" (2000).

Product Brochure, 4 sheets, "Net-All Netting is the Answer to All Youre Horticultural Applications" (2001).

Product Brochure, 6 sheets, "Tipper Net for Smoking, Hanging & Decoration, Net-All Netting is the Answer" (2000).

Rigidized Metals Corporation, Corporate Profile, 1 page, <http://www.rigidized.com> accessed on Sep. 23, 2005, but for the purposes of examination, the reference is deemed to be before the priority filing date of the instant application.

* cited by examiner

METHOD OF PACKAGING USING AN EMBOSSED NETTING CHUTE

RELATED APPLICATIONS

This application is a divisional of U.S. patent application Ser. No. 11/234,494 filed Sep. 23, 2005, now U.S. Pat. No. 7,430,839, which claims priority to U.S. Provisional Application Ser. No. 60/615,753, filed Oct. 4, 2004, the contents of which are hereby incorporated by reference as if recited in full herein.

FIELD OF THE INVENTION

The present invention relates to apparatus that can enclose products in packaging materials, and may be particularly suitable for enclosing products in netting material.

BACKGROUND OF THE INVENTION

Certain types of commodity and/or industrial items can be packaged by placing the desired product(s) in a covering material, then applying a closure clip or clips to end portions of the covering material to secure the product(s) therein. For non-flowable piece goods, the piece goods can be held individually in a respective clipped package, or as a group of goods in a single package. The covering material can be any suitable material, typically a casing and/or netting material.

Generally described, when packaging a piece good product in netting, the product is pushed through a netting chute. The product can include, by way of example, a non-flowable semi-solid and/or solid object such as a meat product including whole or half hams, turkeys, chickens, and the like. The netting chute holds a length of a netting sleeve over the exterior thereof. A first downstream end portion of the netting is typically closed using a first clip. As the product exits the netting chute, it is covered with the netting. The netting can be held relatively tight (typically stretched or in tension) over the product. The open end of the netting (upstream of the product) is then gathered and another clip can be applied to the gathered netting, typically using a double clipper apparatus. Clip attachment apparatus, or "clippers," are well known to those of skill in the art and include those available from Tipper Tie, Inc., of Apex, N.C., under product numbers Z3214, Z3202, and Z3200. Examples of clip attachment apparatus and/or packaging apparatus are described in U.S. Pat. Nos. 3,389,533; 3,499,259; 4,683,700; and 5,161,347, the contents of which are hereby incorporated by reference as if recited in full herein.

The double clipper apparatus concurrently applies two clips to the netting proximate the open (upstream) end of the package. One clip defines the leading end portion of the package and the other defines the trailing or second end portion of the package then being closed. A cutting mechanism incorporated in the clipper apparatus can sever the two packages before the enclosed package is removed from the clipper apparatus. U.S. Pat. No. 4,766,713 describes a double clipper apparatus used to apply two clips to a casing covering. U.S. Pat. No. 5,495,701 proposes a clipper with a clip attachment mechanism configured to selectively fasten a single clip or two clips simultaneously. The contents of these patents are hereby incorporated by reference as if recited in full herein.

SUMMARY OF EMBODIMENTS OF THE INVENTION

Embodiments of the present invention provide netting product chutes that can be used to automatically and/or manually package a product in a covering material and/or applying clips thereto.

Certain embodiments are directed toward netting chutes having an interior primary surface with at least a floor portion that is embossed and an exterior surface adapted to hold netting in tension thereon.

In certain embodiments, the product can be manipulated and packaged so that at least one clip is automatically applied to enclose the product in the covering material. Particular embodiments automatically or semi-automatically clip a discrete object or objects in netting.

Some embodiments are directed toward netting chutes comprising an elongate interior channel having with axially spaced apart, generally open opposing ingress and egress portions with the chute comprising an embossed floor.

In particular embodiments, the embossed floor comprises a generally rigid metal having a dense pattern of closely spaced, raised projections that face into the channel. In other embodiments, the embossed floor comprises a generally rigid metal having a dense pattern of closely spaced dimples. A non-stick coating may be disposed onto the embossed floor. The netting chute can also include a sleeve of netting surrounding at least the egress portion of the chute and axially extending a distance upstream thereof. The sleeve of netting material is configured to be in tension and extend a distance downstream of the egress portion of the chute during operative use.

Other embodiments are directed to systems for enclosing a semi-solid or solid product in a covering material. The systems include: (a) an elongate product chute comprising an embossed floor, an outer wall and opposing ingress and egress end portions with an interior cavity defined by the floor and outer wall extending therethrough; and (b) a clipper mechanism disposed downstream of the egress end portion of the product chute, the clipper mechanism configured to apply at least one clip to a covering material that encloses a product discharged from the product chute.

The embossed floor may include a generally rigid metal having a dense pattern of closely spaced raised projections that face into the channel and/or a dense pattern of closely spaced raised dimples.

Still other embodiments are directed to methods for packaging an object or objects in netting. The methods include: (a) gravity feeding at least one object through an inclined product chute having an embossed floor; (b) pulling netting material from an exterior surface of the product chute to automatically enclose the object in the netting material as the object exits the product chute; then (c) applying at least one clip to the netting material to secure the object in the netting material.

Another embodiment is directed to methods of fabricating a netting chute. The methods include: (a) providing at least one generally rigid metallic sheet; (b) forming the at least one metallic sheet into an elongate non-circular shape; and (c) joining a generally planar embossed metallic sheet to the non-circular shape to define a floor of a netting chute having a non-circular cross-section.

Alternative methods of fabricating a netting chute include the step of forming an embossed metallic sheet into a non-planar shape so that the embossed sheet forms a portion of a floor and extends into side portions of a chute channel. The end portions of the sheet can be joined to each other or to another metallic member to define a generally enclosed channel in a netting chute.

The chute may comprise an entry portion that has a flared segment with a cross-sectional area that tapers into an adjacent downstream portion with a smaller cross-sectional area.

These and other objects and/or aspects of the present invention are explained in detail in the specification set forth below.

DESCRIPTION OF EMBODIMENTS OF THE INVENTION

Figure 1A:
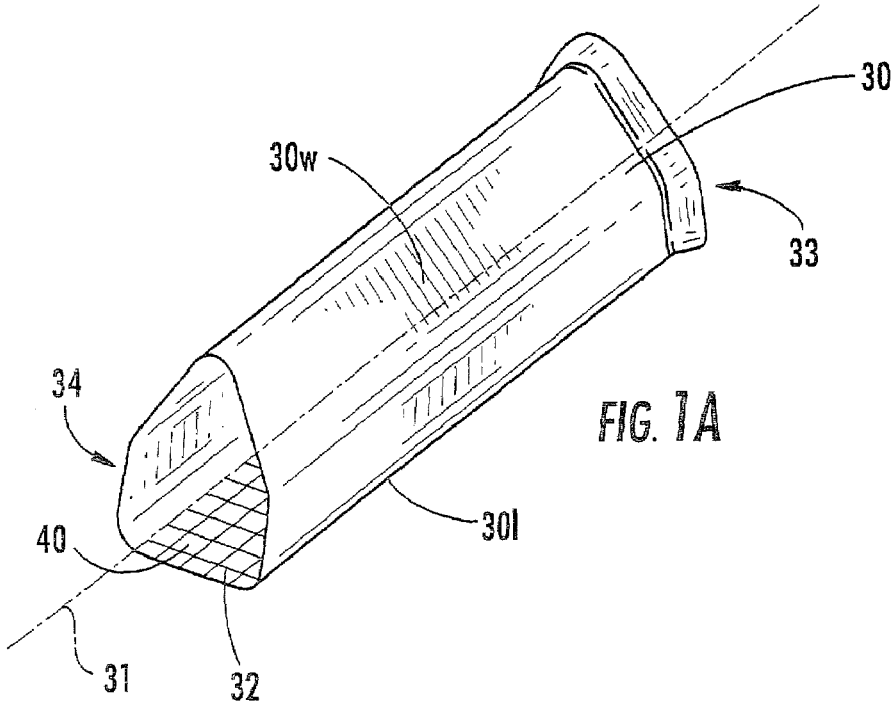
FIG. 1A is a side perspective view of a netting chute according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations, unless specified otherwise. In addition, the sequence of operations (or steps) is not limited to the order presented in the claims unless specifically indicated otherwise. Where used, the terms "attached", "connected", "contacting", "coupling" and the like, can mean either directly or indirectly, unless stated otherwise. The term "concurrently" means that the operations are carried out substantially simultaneously.

In the description of the present invention that follows, certain terms are employed to refer to the positional relationship of certain structures relative to other structures. As used herein, the term "front" or "forward" and derivatives thereof refer to the general or primary direction that the product travels for packaging and closure; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the directions opposite, respectively, the forward and downstream directions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y.

As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Embodiments of the present invention are particularly suitable for applying closure clips to discrete objects held in a covering material. The covering material may be natural or synthetic and may be a casing material that can be sealed about a product or may be netting. The casing can be any suitable casing (edible or inedible, natural or synthetic) such as, but not limited to, collagen, cellulose, plastic, elastomeric or polymeric casing. The term "netting" refers to any open mesh material in any form including, for example, knotted, braided, extruded, stamped, knitted, woven or otherwise. Typically, the netting is configured so as to be stretchable in both axial and lateral directions (i.e., elastic, and typically isotropically elastic).

Netting or other covering material may be used to package discrete meat products such as loaves of meat, boned ham, spiral-sliced ham, deboned ham, half hams, whole hams, turkey, turkey loaves held in molds, or other meat; the packaging may be formed on the item alone or with the items held in subcontainers and/or wraps such as molds, trays, boxes, bags, absorbent or protective sheets, sealant, cans and the like.

Other embodiments of the present invention may be directed to package other types of food such as cheese, bread, fruit, vegetables, and the like. Examples of non-food items that may be packaged using embodiments of the present invention include living items such as flora, trees, and the like, as well as inanimate objects. Additional examples of products include discrete, semi-solid or solid non-flowable objects such as firewood, pet food (typically held in a container if the wet type), recreational objects (such as balls), or other solid or semi-solid objects. The product may be for any suitable industry including horticulture, aquaculture, agriculture, or other food industry, environmental, chemical, explosive, or other application. Netting may be particularly useful to package ham or turkeys, manufactured hardware such as automotive parts, firewood, explosives, molded products, and other industrial, consumable, and/or commodity item(s).

Generally stated, embodiments of the present invention are directed to the packaging of piece goods or discrete items by forcing them through a product chute, wrapping or enveloping the objects at the other end of the chute in a covering material, such as netting, then clipping the covering material with a closure clip or other attachment means to close the covering and hold the object or objects inside of the covering material. As noted above, clippers are available from Tipper Tie, Inc., of Apex, N.C. Examples of suitable clips include metallic generally "U"-shaped clips also available from Tipper Tie, Inc., in Apex, N.C. Other clips, clip materials and clip configurations or closure means may also be used.

FIGS. 1A-1C and 2 illustrate a netting chute 30 according to embodiments of the present invention. As shown, the netting chute 30 has a through-channel 31 and a floor 32. As illustrated by the reference numbered 40 and the cross-hatching in FIG. 1A, the floor 32 is embossed. As used herein, the term "embossed" means a surface with raised or lowered regions that provide a reduced contact surface area with an object that passes through the chute 30. In some embodiments, the embossed floor 32 comprises a three-dimensional, textured, generally repeating pattern formed into sheet metal. In some embodiments, the embossed surface (via its reduced contact surface area) is able to reduce the drag on products traveling through the chute 30. The floor 32 may be embossed for at least a portion of its length and/or width, and is typically embossed substantially its entire length and or width (at least those portions that contact the product). In some embodiments, the embossed pattern can be configured as a dense pattern. The term "dense" means that the pattern is configured with generally repeating closely spaced three-dimensional shapes (typically less than about 0.5 inches between most pattern shapes, and more typically, less than about 0.2 inches, between adjacent pattern objects). In some dense patterns, the pattern shapes are adjacently positioned and sides of adjacent pattern shapes may even contact. In some particular dense patterns, there are at least about 1 pattern shape per about square inch, and in others, there are between about 5-10 per square inch.

The chute 30 has an ingress end portion 33 and an opposing egress end portion 34, each of which is generally open and sized and configured to allow a target object to pass therethrough. The chute 30 has an outer wall 30*w*. The outer wall 30*w* can be a single formed wall member or a series of joined wall members. As shown, the floor 32 can be generally planar and disposed at the lower portion of the outer wall 30*w*.

The wall 30*w* can have a curvilinear cross-sectional shape. Thus, in certain embodiments, the product chute 30 has a cross-sectional profile that is non-circular. As shown in FIG. 1C, the product chute 30 may be configured with a generally planar bottom portion (with a three dimensional, textured, embossed surface) and a non-circular upper portion. Other cross-sectional profile configurations may also be used including, but not limited to, circular, oval, triangular, rectangular, square and the like. In certain embodiments, the chute 30 is configured so that the curvilinear wall 30*w* terminates or merges into the floor 32 so that together they define a non-circular cross-sectional shape of the cavity 30*c*. In other embodiments, the wall 30*w* can extend under and hold the floor 32 to provide support therefor.

In some embodiments, the chute channel 31 (FIGS. 1A and 1C) may be sized to snugly contact or squeeze opposing portions of the product (side to side and/or top to bottom) as the product is pushed therethrough or may be oversized with respect to the product so that the product loosely travels therethrough. The chute 30 shown in FIGS. 1A-1C may be particularly suitable to package half-hams.

Figure 1B:
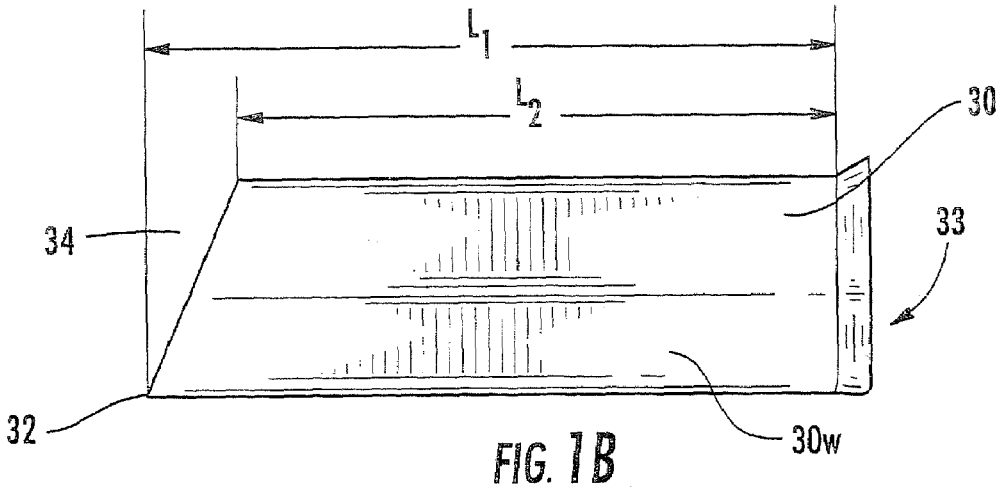
FIG. 1B is a side view of the chute shown in FIG. 1A.
Figure 1C:
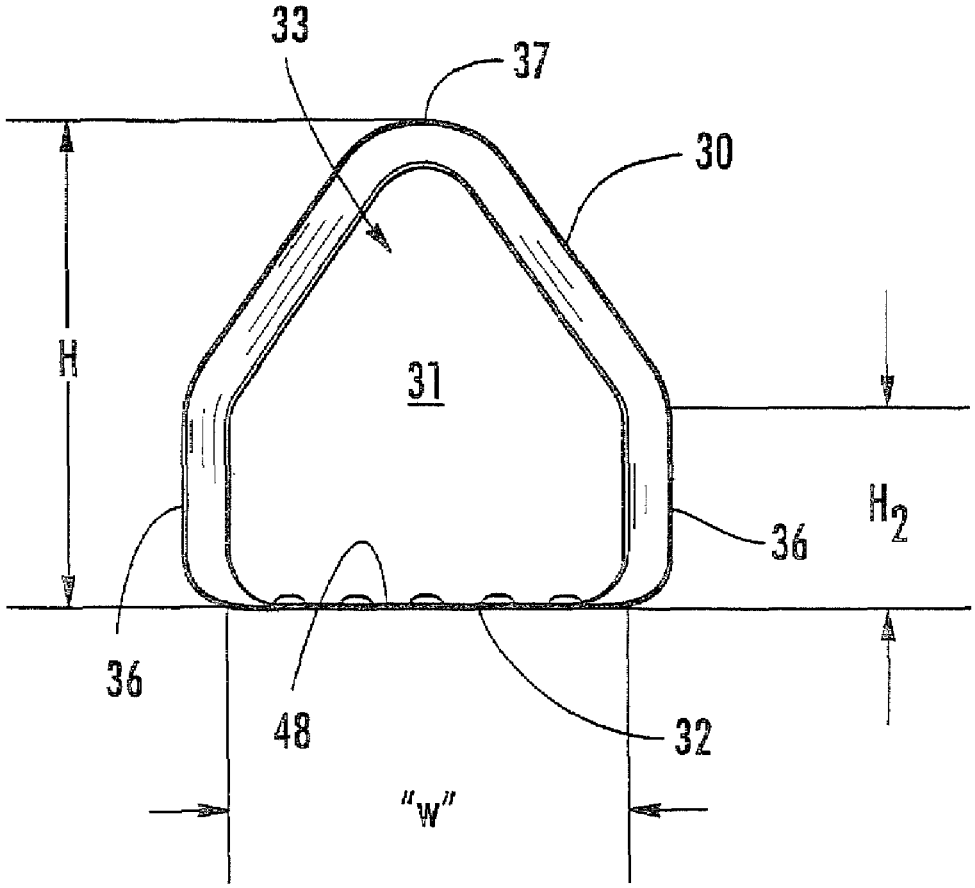
FIG. 1C is an end view of the chute shown in FIG. 1A.

In some embodiments, as shown in FIG. 1B, the chute 30 can vary in length depending on the target object or objects, the netting or covering material used, and the like. In particular embodiments, the chutes can have lengths of between about one (1) foot-eight (8) feet, and more typically between about 2-6 feet. In some embodiments, as shown in FIG. 1B, the chutes 30 can have a long direction length "$L_1$" and the chute may taper from a lower to a top portion so that the lower portion extends the length $L_1$ while the top portion extends a shorter length $L_2$. In other embodiments, the chute 30 can have a single length L. In particular embodiments, the length L (or $L_1$) can be at least about 25 inches, and may be between about 29-35 inches, and, in some embodiments may be between about 32-33 inches. Where used, the length $L_2$ can be about four inches less than $L_1$, and in some embodiments can be between about 25-31 inches, and may be between about 27.5-28.5 inches. Similarly, the chute 30 can have a channel 31 such that at least a major portion of its length has a cross-sectional area that is between about 72 $in^2$ to about 90 $in^2$. The channel 31 can have a width "W" proximate the floor 32 that is between about 8-15 inches, and typically between 8.5-9.5 inches, and a height "H" that is between about 5-15 inches, and typically between about 9.5-10.5 inches.

FIG. 1C illustrates one exemplary cross-sectional shape of channel 31. As shown, the chute 30 can have a generally pentagonal shape. The floor 32 can merge into opposing generally orthogonal sidewall segments 36 that rise and merge with a generally triangulated upper portion 37 of the channel 31. The sidewall segments 36 can have a height $H_2$ that is less than about half that of the tallest height H, and is typically between about 4-5 inches. Other non-circular chute shapes can be used, such as those shown, for example, in co-pending, co-assigned U.S. patent application Ser. No. 10/738,547, now U.S. Pat. No. 7,021,026, the contents of which are hereby incorporated by reference as if recited in full herein. However, in other embodiments, generally circular cross-sectional chutes with embossed portions (or the entire inner surface) can be used.

Figure 2:
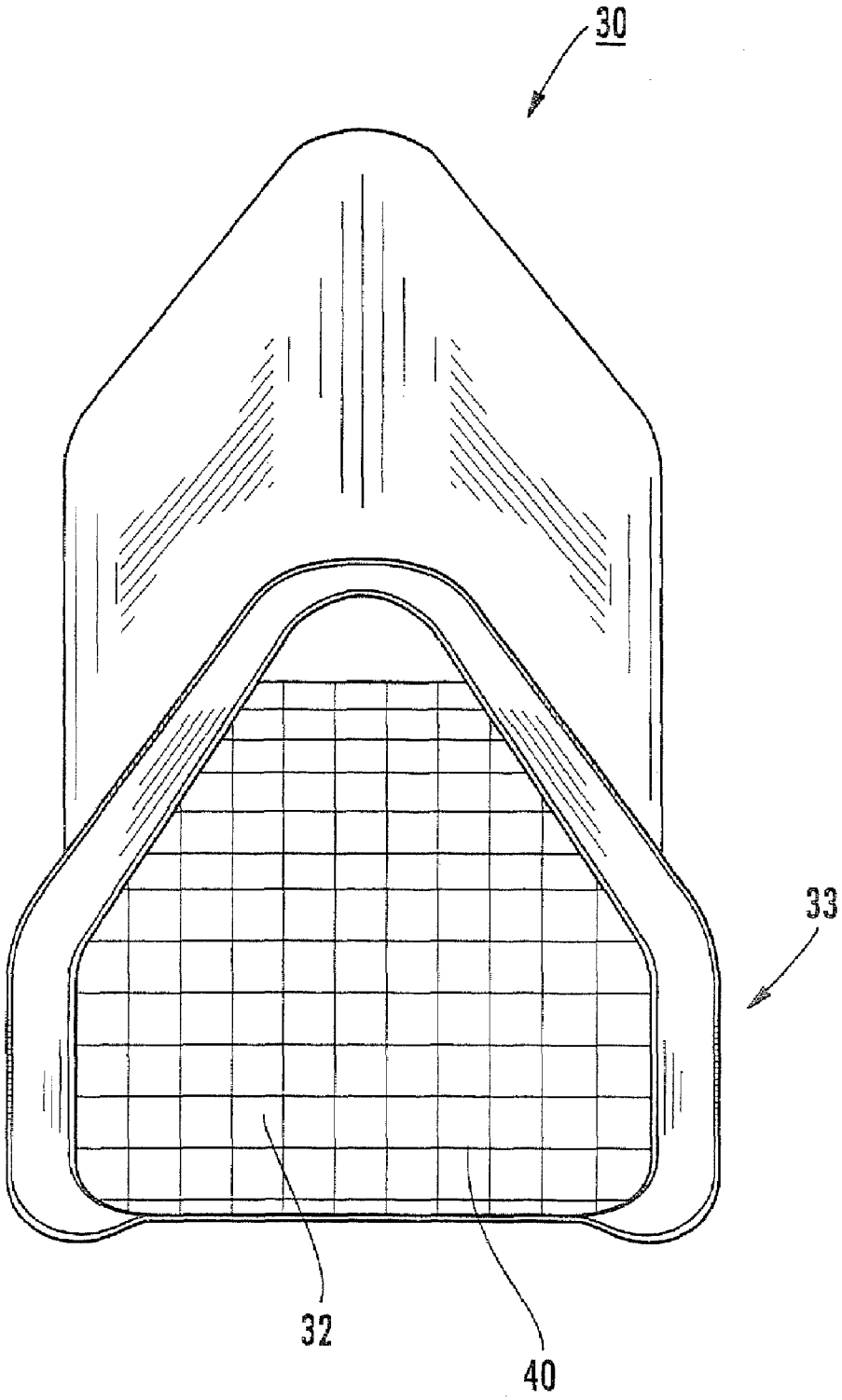
FIG. 2 is an enlarged end perspective view of the chute shown in FIG. 1A.

While FIGS. 1A and 2 illustrate that the chute 30 comprises an embossed floor 32, other portions of the chute may also be embossed. For example, portions or all of the sidewalls and/or ceiling of the chute, or substantially the entire inner surface of the chute 30 may be embossed (see, e.g., FIG. 4B). In particular embodiments, an embossed metallic sheet 41 (FIGS. 4A, 4B) can define at least the embossed floor 32, and may define a portion of the sidewalls 36 and/or ceiling 39.

FIGS. 3A-3E illustrate exemplary embossed surface patterns. Each configuration can be generally referred to as feature 40, while specific configurations are referred to as alphabetic derivatives thereof for discussion. The embossed surface 40 can be configured as a generally continuous surface with a generally repeating pattern. In some embodiments, the pattern can be configured with closely spaced projections separated by depressions, generally planar regions, and/or other surface relief configurations. The surface 40 can comprise dimples, which may be oriented to face away or into the chute channel 31. Combinations of the above may also be used.

The embossed surface can be configured with relatively shallow depressions and/or pattern height so as not to inhibit movement of the product through the chute and/or so as to reduce the potential to trap and/or retain loose components from the object (i.e., food). In particular embodiments, the embossed surface(s) may have projections with a pattern height relative to the adjacent generally level regions and/or depressions of between about 0.20-0.50 inches. The projection widths can vary and in some embodiments may be between about 0.1 inch-1.25 inches.

Figure 3A:
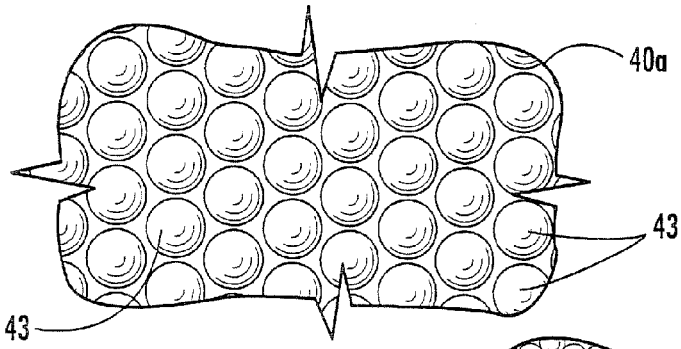
FIGS. 3A-3E are top views of exemplary embossed configurations suitable to form at least a portion of a netting chute according to embodiments of the present invention.
Figure 3B:
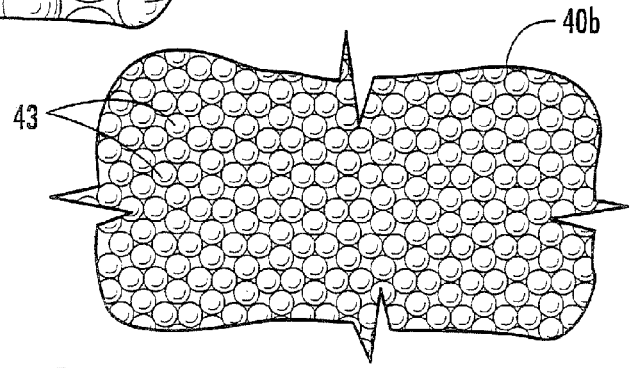
Figure 3C:
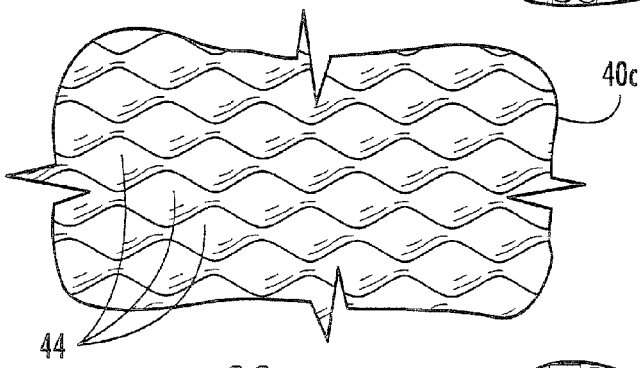
Figure 3D:
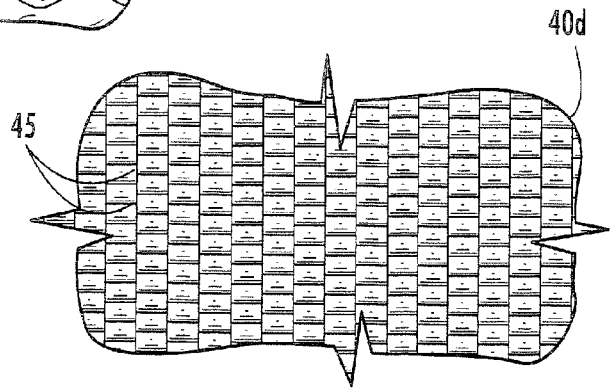
Figure 3E:
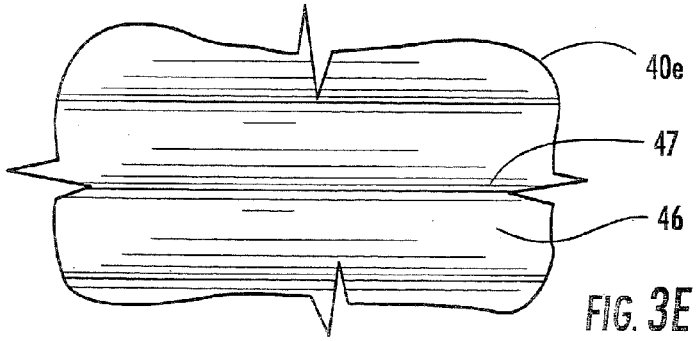

The embossed member can comprise a generally rigid sheet metal, such as stainless steel. Suitable embossed materials can be obtained from Rigidized Metals Corporation, located in Buffalo, N.Y. identified as different RIGIDIZED® patterns. For example, FIGS. 3A and 3B illustrate dense patterns 40*a*, 40*b* with generally semi-spherical projections 43. The projections in FIG. 3B are denser with smaller projection widths than those in FIG. 3A. The pattern of projections shown in FIG. 3A can be described as having a closed honeycomb appearance (the surface is continuous) with at least two opposing side portions of the generally semi-spherical projections being parallel and in a straight line. FIG. 3C illustrates a generally sinusoidal wavelet pattern 40*c* with projections 44. FIG. 3D illustrates a pattern 40*d* with elongate dimples 45. FIG. 3E illustrates a pattern 40*e* with a series of aligned parallel depressions 47, one between each line of generally rectangular shaped (in cross section) projections 46. The configuration shown in FIG. 3A may be particularly suitable for use with half-ham objects.

Although the product chute 30 is shown as having a continuous outer surface or wall, other configurations may also be used. For example, the chute wall or walls may include a slot or apertures and may not be a closed configuration depending on the application. However, the chute 30 should be configured to provide sufficient structural support for the covering material (typically sized and configured to hold the covering stretched in both lateral and longitudinal directions) and to allow the product to enter the product material as it exits the product chute 30.

The product chute body may include a single continuous wall that defines the shape of the cavity 30*c* above the floor 30*f*. In other embodiments, the product chute body can be formed with a plurality of walls. In some embodiments, the product chute 30 is fabricated from stainless steel. The interior surface or portions thereof may be coated with an anti-stick coating and/or lubricant. For example, the interior of the chute floor 32 and/or inner surface may comprise TEFLON® polymer. In particular embodiments, a single or multiple sheets of generally rigid sheet metal can be formed to provide the desired product chute body shape.

Figure 4A:
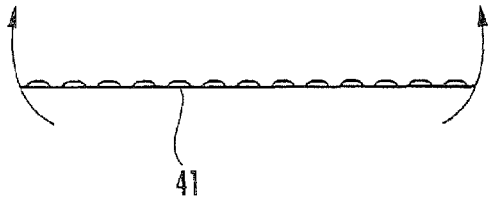
FIGS. 4A and 4B are schematic illustrations of netting chute fabricating operations according to embodiments of the present invention.
Figure 4B:
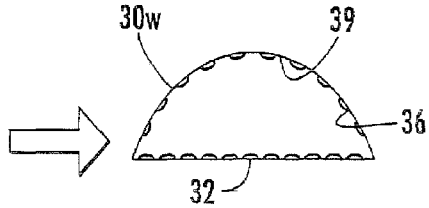

FIGS. 4A and 4B illustrate forming an embossed metallic sheet 41 into a non-planar shape so that the embossed sheet forms a floor 32 and side portions 36 of a chute channel 30. The embossed sheet 41 can also form at least a portion of a ceiling 39 of the channel 31. The end portions of the sheet 41 can be joined to each other or to another metallic member to define a generally enclosed channel in a netting chute.

Figure 5A:
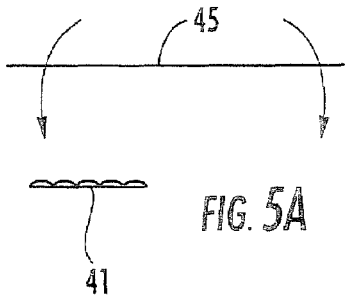
FIGS. 5A and 5B are schematic illustrations of alternative netting chute fabricating operations according to embodiments of the present invention.
Figure 5B:
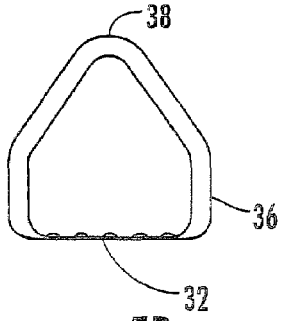

FIGS. 5A and 5B illustrate one method of fabricating a netting chute 30. As shown, at least one generally rigid metallic sheet 45 is provided, formed into an elongate non-circular shape, and a generally planar embossed metallic sheet 41 is joined to the non-circular shape to define a floor 32 of a netting chute having a non-circular cross-section. The joining can be via welding, brazing, chemical or mechanical attachment.

Figure 7:
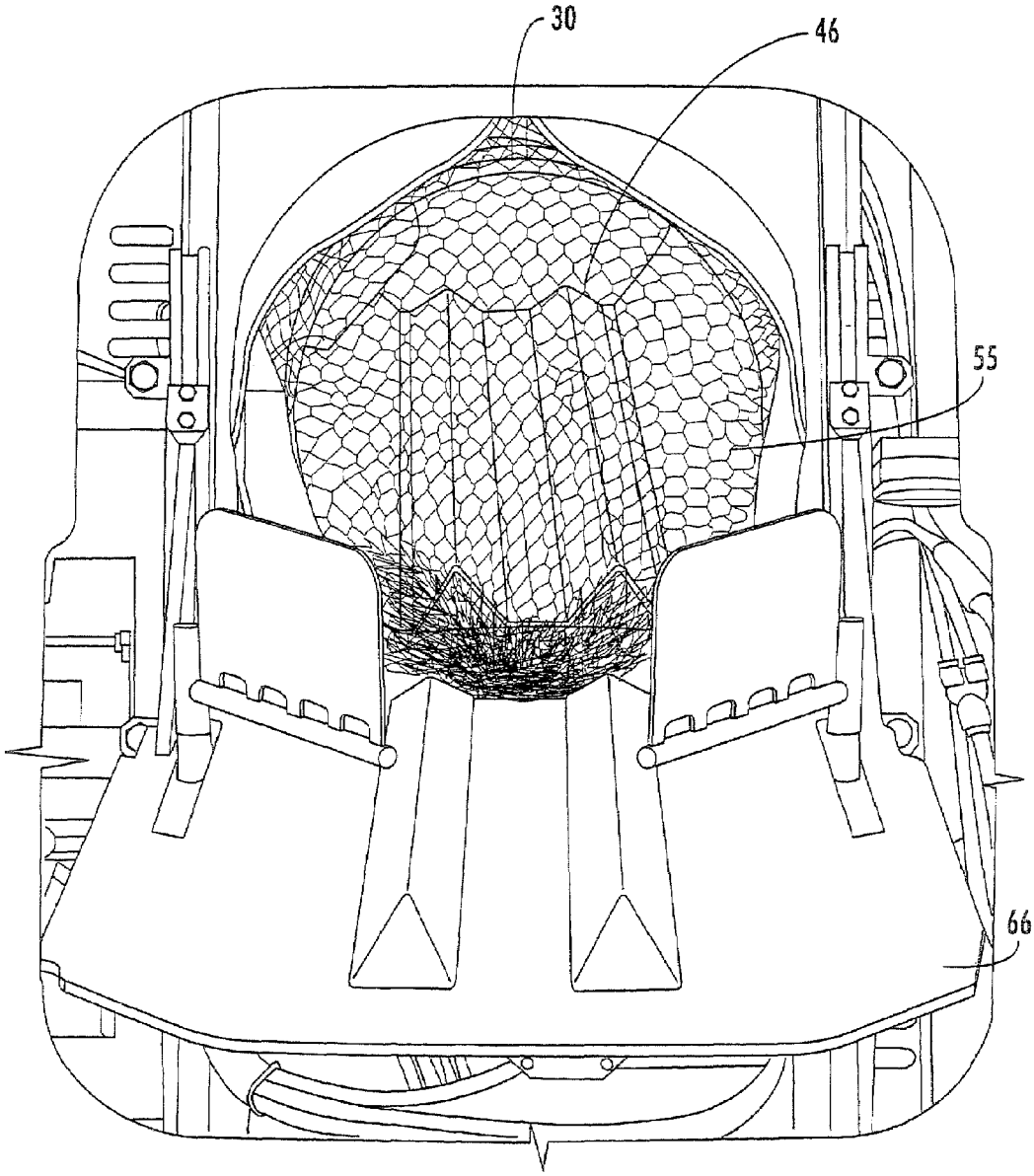
FIG. 7 is an end view of the apparatus shown in FIG. 6A, showing the chute in position with netting material therearound according to embodiments of the present invention.

In some embodiments, as shown in FIG. 7, the embossed chute floor 32 may include at least one axially extending rib 46 that extends at least a partial length of the chute 30 and has a height such that it extends vertically above the projections and the general height of adjacent portions of the floor 32. The term "rib" means a generally axially extending projection that is sized and configured so that it can influence the movement and/or positioning of a product as the product enters and/or travels through the chute 30.

Figure 6A:
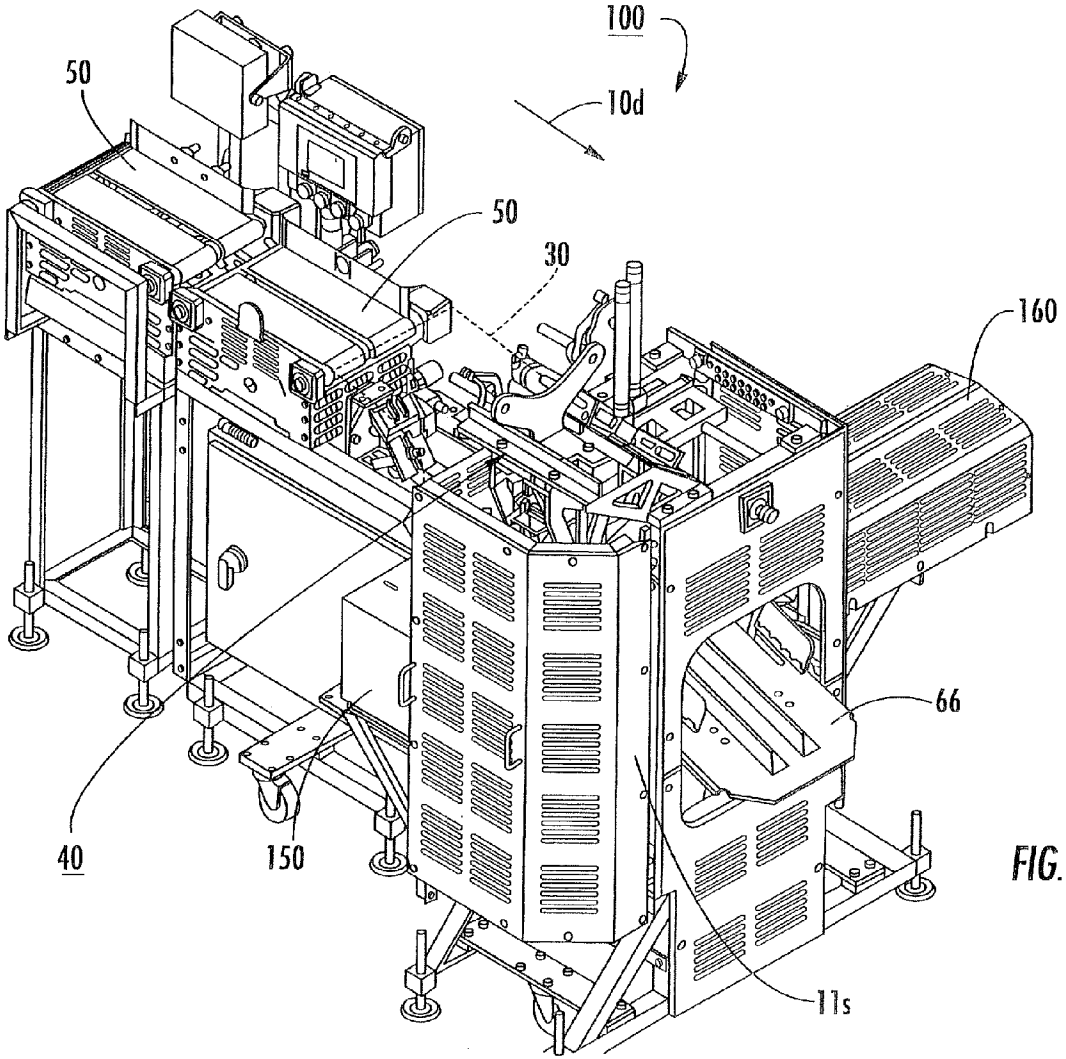
FIG. 6A is a perspective view of an apparatus/system used to advance objects through a product chute via gravity feed, then apply a clip(s) via a clipper mechanism according to embodiments of the present invention.
Figure 6B:
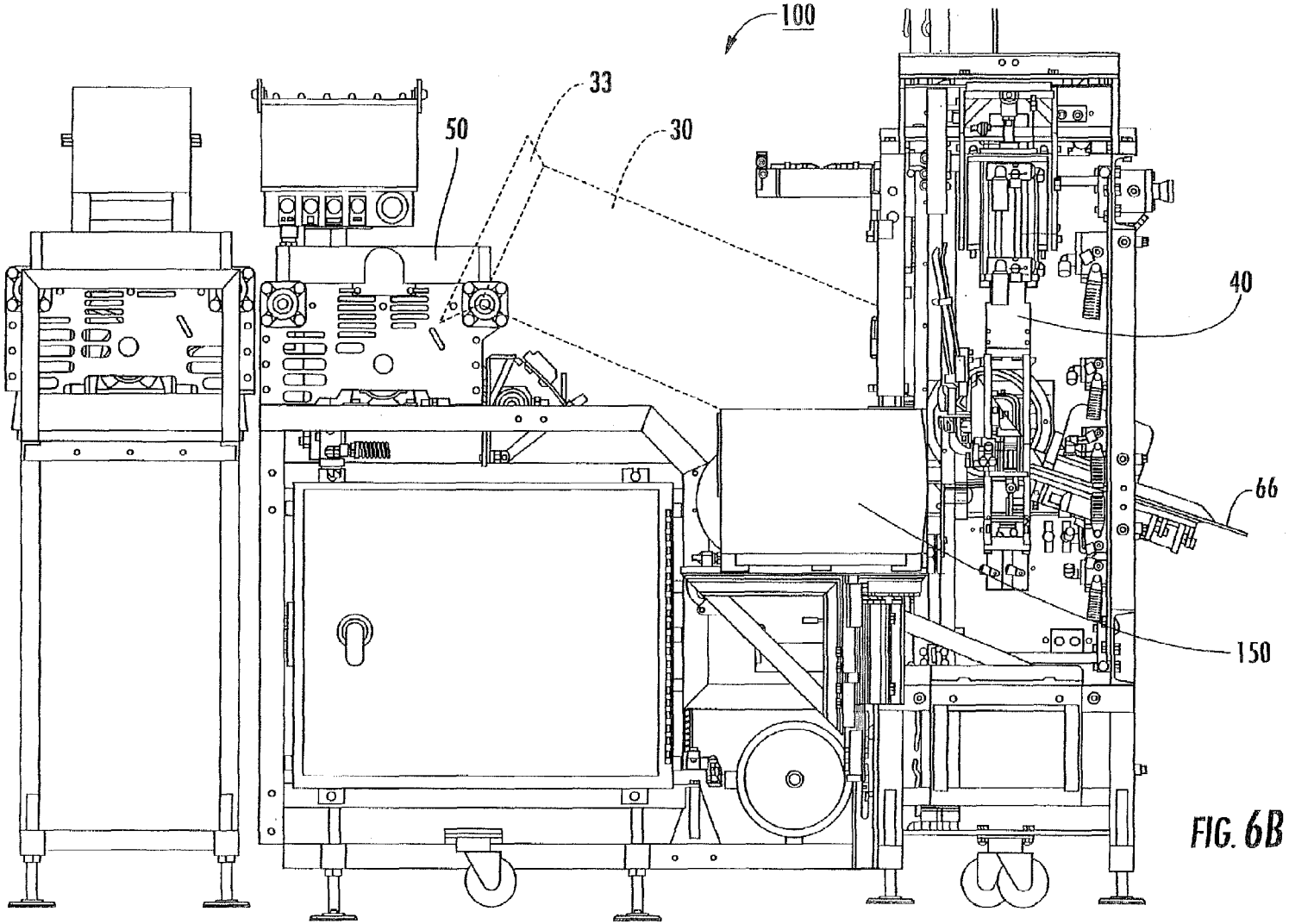
FIG. 6B is rear view of the apparatus shown in FIG. 6A with certain housing covers omitted from the clipper mechanism for clarity according to embodiments of the present invention.

FIGS. 6A and 6B illustrate an exemplary automatic clipping packaging apparatus 100 according to embodiments of the present invention. As shown, the apparatus 100 includes a product chute 30, and a clipper 40. It is noted that the clipper 40 may be referred to herein as a clipper apparatus, clipper mechanism, and/or clipper assembly, but each term may be used interchangeably with the others. As shown, the apparatus 100 may optionally include at least one infeed conveyor 50 (shown as two in communication with each other upstream of the chute 30), a label printer 150, a discharge table or platen 66 and a handle-maker 160. In particular embodiments, as shown in FIG. 6B, the chute 30 may be tilted from horizontal, typically so that the egress end 34 is closer the ground than the product entry or ingress end 33. The tilt may be configured so that the chute 30 extends angularly down at between about 30-60 degrees. The direction of travel of an exemplary product undergoing packaging is illustrated by the arrow 10*d* illustrating downstream in FIG. 6A.

In operation, a product is conveyed down member 50 and introduced (typically dropped) into chute 30. A sleeve of covering material 55 (see FIG. 7) can be positioned about the external surface of the product chute 30 and configured to be drawn downstream thereof so as to automatically encase an object as the object emerges (via gravity feed) from the egress end 34 of the chute 30. A supplemental sleeve material holder may also be used if desired instead of placing the sleeve of material 55 directly on the outer wall of the chute 30. The supplemental sleeve holder can be configured to surround a downstream portion of the product chute (not shown). The sleeve of covering material 55 may be sized to stretch to substantially conform to the external wall or surface of the chute 30 or may be more loosely held thereon.

In some embodiments, the shape, size and/or type of object or product can determine a suitable netting diameter and/or chute size to provide a desired tightness of netting and, hence, influence the chute design factor. In operation, a supply of covering material 55 (FIG. 7) can be placed on or about the chute 30 and arranged to surround the exterior surface of at least a portion of the product chute 30. The covering material 55 stretches in tension in the downstream direction to cover the product (tenting in the axial direction) as the product exits the discharge end portion 34 of the chute 30. In certain embodiments, the covering material is configured and sized to stretch in at least the lateral direction and typically in both the lateral and axial directions as it is held on and dispensed from the chute 30.

The product chute floor 32 may be a stationary embossed floor as shown. However, it is also noted that the chute 30 may include an embossed moving floor (not shown). The chute 30 may be sized relative to the product so that the product extends across a major portion of the width of the cavity, and in certain embodiments, extends across at least about 75% of the width of the cavity. In certain embodiments the target product and chute channel 31 are sized so that the sides and/or top and bottom of the product are pressed against the sidewalls (and floor, and potentially the ceiling) of the chute 30 as the product is pushed therethrough.

The product chute 30 can include a handle or other suitable gripping means (not shown) thereon to facilitate operator handling. In addition, the product chute 30 may include a mounting bracket (also not shown) that allows the chute 30 to be secured to a mounting frame during operation.

In operation, the sleeve of covering material may be clipped, welded, fused, knotted or otherwise closed at a leading edge portion thereof. When the product exits the product chute 30, it is held in the covering material 55 as the covering material is drawn downstream. The covering material is typically loaded onto the product chute 30 and the leading edge portion closed before the product chute 30 is mounted to the apparatus 10. Additional description of a suitable clipping apparatus is described in U.S. Pat. No. 6,729,102, the contents of which were incorporated by reference above.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method of packaging an object or objects in netting, comprising:

feeding at least one object through a product chute having an embossed floor;

pulling netting material from an exterior surface of the product chute to automatically enclose the object in the netting material as the object exits the product chute; then applying at least one clip to the netting material to secure the object in the netting material, wherein the embossed floor comprises a generally rigid metallic sheet of material with a dense pattern of closely spaced apart projections.

2. A method according to claim 1, wherein the feeding step comprises sliding with gravitational assistance.

3. A method according to claim 1, wherein the applying step is carried out using an automated or semi-automated clipper mechanism positioned downstream of the product chute.

4. A method according to claim 1, wherein the object is a meat object.

5. A method according to claim 4, wherein the meat object comprises ham and/or poultry.

6. A method of packaging an object or objects in netting, comprising:

feeding at least one object through a product chute having an embossed floor;

pulling netting material from an exterior surface of the product chute to automatically enclose the object in the netting material as the object exits the product chute; then applying at least one clip to the netting material to secure the object in the netting material, wherein the embossed floor comprises a generally rigid metallic sheet of material with a dense pattern of closely spaced apart dimples.

7. A method according to claim 6, wherein the feeding step comprises sliding with gravitational assistance.

8. A method according to claim 6, wherein the applying step is carried out using an automated or semi-automated clipper mechanism positioned downstream of the product chute.

9. A method according to claim 6, wherein the object is a meat object.

10. A method according to claim 9, wherein the meat object comprises ham and/or poultry.

11. A method of packaging an object or objects in netting, comprising:

feeding at least one object through a product chute having an embossed floor;

pulling netting material from an exterior surface of the product chute to automatically enclose the object in the netting material as the object exits the product chute; then applying at least one clip to the netting material to secure the object in the netting material, wherein the embossed floor of the product chute is an integral non-detachable embossed floor of a dense pattern of closely spaced three-dimensional shapes with at least one of raised or lowered regions that define a reduced contact surface area, wherein the chute is substantially straight with a length of between about 1-8 feet.

12. A method according to claim 11, wherein the product chute floor has a cross-sectional area that is between about 72 $in^2$ to about 90 $in^2$.

13. A method according to claim 11, wherein the feeding step comprises sliding with gravitational assistance.

14. A method according to claim 11, wherein the applying step is carried out using an automated or semi-automated clipper mechanism positioned downstream of the product chute.

15. A method according to claim 11, wherein the object is a meat object.

16. A method according to claim 15, wherein the meat object comprises ham and/or poultry.

17. A method of packaging an object or objects in netting, comprising:

sliding at least one object through product chute having a floor with a dense pattern of closely spaced three-dimensional shapes, wherein the dense pattern of closely spaced three-dimensional shapes comprises at least one three-dimensional shape per square inch;

pulling netting material from an exterior surface of the product chute to automatically enclose the object in the netting material as the object exits the product chute; then applying at least one clip to the netting material to secure the object in the netting material.

18. A method according to claim 17, wherein the floor comprises a generally rigid metal having the dense pattern, and wherein the dense pattern of closely spaced three-dimensional shapes comprises raised projections that face into the channel.

19. A method according to claim 17, wherein the floor comprises a generally rigid metal, and wherein the dense pattern of closely spaced three-dimensional shapes comprises a dense pattern of closely spaced dimples.

20. A method according to claim 17, further comprising a non-stick coating disposed onto the floor to facilitate the sliding step.

21. A method according to claim 17, wherein the object is a single partial ham.

* * * * *

UNITED STATES PATENT AND TRADEMARK OFFICE

CERTIFICATE OF CORRECTION

PATENT NO. : 7,647,748 B2
APPLICATION NO. : 12/201244
DATED : January 19, 2010
INVENTOR(S) : Griggs et al.

It is certified that error appears in the above-identified patent and that said Letters Patent is hereby corrected as shown below:

Column 10, Claim 17, Line 41: Please correct "through product"
to read -- through a product --

Signed and Sealed this

Twenty-seventh Day of April, 2010

David J. Kappos

David J. Kappos
*Director of the United States Patent and Trademark Office*